US006804649B2

(12) United States Patent
Miranda

(10) Patent No.: US 6,804,649 B2
(45) Date of Patent: Oct. 12, 2004

(54) EXPRESSIVITY OF VOICE SYNTHESIS BY EMPHASIZING SOURCE SIGNAL FEATURES

(75) Inventor: Eduardo Reck Miranda, Paris (FR)

(73) Assignee: Sony France S.A., Clichy la Garenne (FR)

( * ) Notice: Subject to any disclaimer, the term of this patent is extended or adjusted under 35 U.S.C. 154(b) by 397 days.

(21) Appl. No.: 09/872,966

(22) Filed: Jun. 1, 2001

(65) Prior Publication Data

US 2002/0026315 A1 Feb. 28, 2002

(30) Foreign Application Priority Data

Jun. 2, 2000 (EP) ..... 00401560

(51) Int. Cl.[7] ..... G10L 13/00; G10L 13/02

(52) U.S. Cl. ..... 704/258; 704/263; 704/269; 704/264

(58) Field of Search ..... 704/258, 211, 704/269, 200, 201, 261, 265, 206, 500, 503, 266

(56) References Cited

U.S. PATENT DOCUMENTS

| | | | | |
|---|---|---|---|---|
| 3,982,070 A | | 9/1976 | Flanagan | |
| 3,995,116 A | | 11/1976 | Flanagan | |
| 5,278,943 A | * | 1/1994 | Gasper et al. | 704/200 |
| 5,327,518 A | * | 7/1994 | George et al. | 704/211 |
| 5,473,759 A | * | 12/1995 | Slaney et al. | 704/266 |
| 5,528,726 A | * | 6/1996 | Cook | 704/261 |
| 5,890,118 A | * | 3/1999 | Kagoshima et al. | 704/265 |
| 6,182,042 B1 | * | 1/2001 | Peevers | 704/269 |
| 6,195,632 B1 | * | 2/2001 | Pearson | 704/206 |
| 6,526,325 B1 | * | 2/2003 | Sussman et al. | 704/503 |

FOREIGN PATENT DOCUMENTS

EP 1 005 021 5/2000

OTHER PUBLICATIONS

"Software for a Cascade/Parallel Formant Synthesizer" by D. Klatt from the Journal of the Acoustical Society of America, 63(2), pp 971–995, 1980.

"Articulatory Model for the Study of Speech Production" by P. Mermelstein from the Journal of the Acoustical Society of America, 53(4), pp 1070–1082, 1973.

"SPASM: A Real–time Vocal Tract Physical Model Editor/Controller and Singer" by P.R. Cook, in Computer Music Journal, 17(1), pp 30–42, 1993.

"Waveguide Filter Tutorial" by J.O. Smith, from the Proceedings of the International Computer Music Conference, pp 9–16, Urbana (IL):ICMA, 1987.

(List continued on next page.)

*Primary Examiner*—Richemond Dorvil
*Assistant Examiner*—Daniel Nolan
(74) *Attorney, Agent, or Firm*—Frommer Lawrence & Haug LLP; William S. Frommer; Darren M. Simon

(57) ABSTRACT

Voice synthesis with improved expressivity is obtained in a voice synthesiser of source-filter type by making use of a library of source sound categories in the source module. Each source sound category corresponds to a particular morphological category and is derived from analysis of real vocal sounds, by inverse filtering so as to subtract the effect of the vocal tract. The library may be parametrical, that is, the stored data corresponds not to the inverse-filtered sounds themselves but to synthesis coefficients for resynthesising the inverse-filtered sounds using any suitable re-synthesis technique, such as the phase vocoder technique. The coefficients are derived by Short Time Fourier Transform (STFT) analysis.

10 Claims, 5 Drawing Sheets

OTHER PUBLICATIONS

"Voice Transformation using the PSOLA Technique" by H. Valbret et al., Speech Communication, 11, No. 2/3, Jun. 1992, pp 175–187.

Miranda E. R.: "A phase vocoder model of the glottis for expressive voice synthesis" 9TH Sony Research Forum, SRF Technical Digest, 1999, pp. 150–152, XP002172507 Tokyo.

Cook P.: "Toward the Perfect Audio Morph? Singing Voice Synthesis and Processing" Workshop on Digital Audio Effects 98, Proceedings of DAFX98, Nov. 19–21, 1998, pp. 223–230, XP002151707.

Database Inspec Online! Institute of Electrical Engineers, Stevenage, GB; Yahagi T et al: "Estimation of Glottal Waves Based on Nonminimum–Phase Models" Database accession No. 6051709 XP002151708 * abstract * & Electronics and Communications in Japan, Part 3 (Fundamental Electronic Science), Nov. 1998, Scripta Technica, USA, vol. 81, No. 11, pp. 56–66.

Veldhuis R et al: "Time–Scale and Pitch Modifications of Speech Signals and Resynthesis from the Discrete Short–Time Fourier Transform" Speech Communication, NL, Elsevier Science Publishers, Amsterdam, vol. 18, No. 3, May 1, 1996, pp. 257–279, XP004018610.

* cited by examiner

EXPRESSIVITY OF VOICE SYNTHESIS BY EMPHASIZING SOURCE SIGNAL FEATURES

BACKGROUND OF THE INVENTION

1. Field of the Invention

The present invention relates to the field of voice synthesis and, more particularly to improving the expressivity of voiced sounds generated by a voice synthesiser.

2. Description of the Prior Art

In the last few years there has been tremendous progress in the development of voice synthesisers, especially in the context of text-to-speech (TTS) synthesisers. There are two main fundamental approaches to voice synthesis, the sampling approach (sometimes referred to as the concatenative or diphone-based approach) and the source-filter (or "articulatory" approach). In this respect see "Computer Sound Synthesis for the Electronic Musician" by E. R. Miranda, Focal Press, Oxford, UK, 1998.

The sampling approach makes use of an indexed database of digitally recorded short spoken segments, such as syllables, for example. When it is desired to produce an utterance, a playback engine then assembles the required words by sequentially combining the appropriate recorded short segments. In certain systems, some form of analysis is performed on the recorded sounds in order to enable them to be represented more effectively in the database. In others, the short spoken segments are recorded in encoded form: for example, in U.S. Pat. No. 3,982,070 and U.S. Pat. No. 3,995,116 the stored signals are the coefficients required by a phase vocoder in order to regenerate the sounds in question.

The sampling approach to voice synthesis is the approach that is generally preferred for building TTS systems and, indeed, it is the core technology used by most computer-speech systems currently on the market.

The source-filter approach produces sounds from scratch by mimicking the functioning of the human vocal tract—see FIG. 1. The source-filter model is based upon the insight that the production of vocal sounds can be simulated by generating a raw source signal that is subsequently moulded by a complex filter arrangement. In this context see, for example, "Software for a Cascade/Parallel Formant Synthesiser" by D. Klatt from the Journal of the Acoustical Society of America, 63(2), pp. 971–995, 1980.

In humans, the raw sound source corresponds to the outcome from the vibrations created by the glottis (opening between the vocal chords) and the complex filter corresponds to the vocal tract "tube". The complex filter can be implemented in various ways. In general terms, the vocal tract is considered as a tube (with a side-branch for the nose) sub-divided into a number of cross-sections whose individual resonances are simulated by the filters.

In order to facilitate the specification of the parameters for these filters, the system is normally furnished with an interface that converts articulatory information (e.g. the positions of the tongue, jaw and lips during utterance of particular sounds) into filter parameters; hence the reason the source-filter model is sometimes referred to as the articulatory model (see "Articulatory Model for the Study of Speech Production" by P. Mermelstein from the Journal of the Acoustical Society of America, 53(4), pp. 1070–1082, 1973). Utterances are then produced by telling the program how to move from one set of articulatory positions to the next, similar to a key-frame visual animation. In other words, a control unit controls the generation of a synthesised utterance by setting the parameters of the sound source(s) and the filters for each of a succession of time periods, in a manner which indicates how the system moves from one set of "articulatory positions", and source sounds, to the next in successive time periods.

There is a need for an improved voice synthesiser for use in research into the fundamental mechanisms of language evolution. Such research is being performed, for example, in order to improve the linguistic abilities of computer and robotic systems. One of these fundamental mechanisms involves the emergence of phonetic and prosodic repertoires. The study of these mechanisms requires a voice synthesiser that is able to: i) support evolutionary research paradigms, such as self-organisation and modularity, ii) support a unified form of knowledge representation for both vocal production and perception (so as to be able to support the assumption that the abilities to speak and to listen share the same sensory-motor mechanisms), and iii) speak and sing expressively (including emotion and paralinguistic features).

Synthesisers based on the sampling approach do not suit any of the three basic needs indicated above. Conversely, the source-filter approach is compatible with requirements i) and ii) above, but the systems that have been proposed so far need to be improved in order to best fulfil requirement iii).

The present inventor has found that the articulatory simulation used in conventional voice synthesisers based on the source-filter approach works satisfactorily for the filter part of the synthesiser but the importance of the source signal has been largely overlooked. Substantial improvements in the quality and flexibility of source-filter synthesis can be made by addressing the importance of the glottis more carefully.

The standard practice is to implement the source component using two generators: one generator of white noise (to simulate the production of consonants) and one generator of a periodic harmonic pulse (to simulate the production of vowels). The general structure of a voice synthesiser of this conventional type is illustrated in FIG. 2. By carefully controlling the amount of signal that each generator sends to the filters, one can roughly simulate whether the vocal folds are tensioned (for vowels) or not (for consonants). The main limitations with this method are:

a) The mixing of the noise signal with the pulse signal does not sound realistic: the noise and pulse signals do not blend well together because they are of a completely different nature. Moreover, the rapid switches from noise to pulse, and vice-versa (needed to make words with consonants and vowels) often produces a "buzzy" voice.

b) The spectrum of the pulse signal is composed of harmonics of its fundamental frequency (i.e. FO, 2*FO, 2*(2*FO), 2*(2*(2*FO)) etc.). This implies a source signal whose components cannot vary before entering the filters, thus holding back the timbre quality of the voice.

c) The spectrum of the pulse signal has a fixed envelope where the energy of each of its harmonics decreases exponentially by −6 dB as they double in frequency. A source signal that always has the same spectral shape undermines the flexibility to produce timbral nuances in the voice. Also, high frequency formants are prejudiced in the case where they need to be of higher energy value than the lower ones.

d) In addition to b) and c) above, the spectrum of the source signal lacks a dynamical trajectory: both frequency distances between the spectral components and their amplitudes are static from the outset to the end of a given time period. This lack of time-varying attributes impoverishes the prosody of the synthesised voice.

A particular speech synthesizer based on the source-filter approach has been proposed in U.S. Pat. No. 5,528,726 (Cook), in which different glottal source signals are synthesized. In this speech synthesizer, the filter arrangement uses a digital waveguide network and a parameter library is employed that stores sets of waveguide junction control parameters and associated glottal source signal parameters for generating sets of predefined speech signals. In this system, the basic glottal pulse making up the different glottal source signals is approximated by a waveform which begins as a raised cosine waveshape but then continues in a straight-line portion (closing edge) leading down to zero and remaining at zero for the rest of the period. The different glottal source signals are formed by varying the beginning and ending points of the closing edge, with fixed opening slope and time. Rather than storing representations of these different glottal source signals, the Cook system stores parameters of a Fourier series representation of the different source signals.

Although the Cook system involves a synthesis of different types of glottal source signal, based on parameters stored in a library, with a view to subsequent filtering by an arrangement modelling the vocal tract, the different types of source signal are generated based on a single cycle of a respective basic pulse waveform derived from a raised cosine function. More importantly, there is no optimisation of the different types of source signal with a view to improving expressivity of the final sound signal output from the global source-filter type synthesizer.

SUMMARY OF THE INVENTION

The preferred embodiments of the present invention provide a method and apparatus for voice synthesis adapted to fulfil all of the above requirements i)–iii) and to avoid the above limitations a) to d). In particular, the preferred embodiments of the invention improve expressivity of the synthesised voice (requirement iii) above), by making use of a parametrical library of source sound categories each corresponding to a respective morphological category.

The preferred embodiments of the present invention further provide a method and apparatus for voice synthesis in which the source signals are based on waveforms of variable length, notably waveforms corresponding to a short segment of a sound that may include more than one cycle of a repeating waveform of substantially any shape.

The preferred embodiments of the present invention yet further provide a method and apparatus for voice synthesis in which the source signal categories are derived based on analysis of real speech.

In the preferred embodiments of the present invention, the source component of a synthesiser based on the source-filter approach is improved by replacing the conventional pulse generator by a library of morphologically-based source sound categories that can be retrieved to produce utterances. The library stores parameters relating to different categories of sources tailored for respective specific classes of utterances, according to the general morphology of these utterances. Examples of typical classes are "plosive consonant to open vowel", "front vowel to back vowel", a particular emotive timbre, etc. The general structure of this type of voice synthesiser according to the invention is indicated in FIG. 3.

Voice synthesis methods and apparatus according to the present invention enable an improvement to be obtained in the smoothness of the synthesised utterances, because signals representing consonants and vowels both emanate from the same type of source (rather than from noise and/or pulse sources).

According to the present invention it is preferred that the library should be "parametrical", in other words the stored parameters are not the sounds themselves but parameters for sound synthesis. The resynthesised sound signals are then used as the raw sound signals which are input to the complex filter arrangement modelling the vocal tract. The stored parameters are derived from analysis of speech and these parameters can be manipulated in various ways, before resynthesis, in order to achieve better performance and more expressive variations.

The stored parameters may be phase vocoder module coefficients (for example coefficients for a digital tracking phase vocoder (TPV) or "oscillator bank" vocoder), derived from the analysis of real speech data. Resynthesis of the raw sound signals by the phase vocoder is a type of additive re-synthesis that produces sound signals by converting Short Time Fourier Transform (STFT) data into amplitude and frequency trajectories (or envelopes) [see the book by E. R. Miranda quoted supra]. The output from the phase vocoder is supplied to the filter arrangement that simulates the vocal tract.

Implementation of the library as a parametrical library enables greater flexibility in the voice synthesis. More particularly, the source synthesis coefficients can be manipulated in order to simulate different glottal qualities. Moreover, phase vocoder-based spectral transformations can be made on the stored coefficients before resynthesis of the source sound, thereby making it possible to achieve richer prosody.

It is also advantageous to implement time-based transformations on the resynthesized source signal before it is fed to the filter arrangement. More particularly, the expressivity of the final speech signal can be enhanced by modifying the way in which the pitch of the source signal varies over time (and, thus, modifying the "intonation" of the final speech signal). The preferred technique for achieving this pitch transformation is the Pitch-Synchronous Overlap and Add (PSOLA) technique.

BRIEF DESCRIPTION OF THE DRAWINGS

Further features and advantages of the present invention will become clear from the following description of a preferred embodiment thereof, given by way of example, illustrated by the accompanying drawings, in which:

FIG. 8 illustrates some of the different types of transformations that can be applied to the glottal source categories defined according to the preferred embodiment of the present invention, in which:

FIG. 8*a*) illustrates spectral time-stretching,

FIG. 8*b*) illustrates spectral shift, and

FIG. 8*c*) illustrates spectral stretching.

DETAILED DESCRIPTION OF THE PREFERRED EMBODIMENTS

As mentioned above, in the voice synthesis method and apparatus according to preferred embodiments of the invention, the conventional sound source of a source-filter type synthesiser is replaced by a parametrical library of morphologically-based source sound categories.

Any convenient filter arrangement, such as waveguide or band-pass filtering, modelling the vocal tract can be used to process the output from the source module according to the present invention. Optionally, the filter arrangement can model not just the response of the vocal tract but can also take into account the way in which sound radiates away from the head. The corresponding conventional techniques can be used to control the parameters of the filters in the filter arrangement. See, for example, Klatt quoted supra.

However, preferred embodiments of the invention use the waveguide ladder technique (see, for example, "Waveguide Filter Tutorial" by J. O. Smith, from the Proceedings of the international Computer Music Conference, pp. 9–16, Urbana (Ill.):ICMA, 1987) due to its ability to incorporate non-linear vocal tract losses in the model (e.g. the viscosity and elasticity of the tract walls). This is a well known technique that has been successfully employed for simulating the body of various wind musical instruments, including the vocal tract (see "Towards the Perfect Audio Morph? Singing Voice Synthesis and Processing" by P. R. Cook, from DAFX98 Proceedings, pp. 223–230, 1998).

Descriptions of suitable filter arrangements and the control thereof are readily available in the literature in this field and so no further details thereof are given here.

The building up of the parametrical library of source sound categories, and the use thereof in the generation of source sounds, in the preferred embodiments of the invention will be described below with reference to FIGS. 4 to 8.

Figure 4:
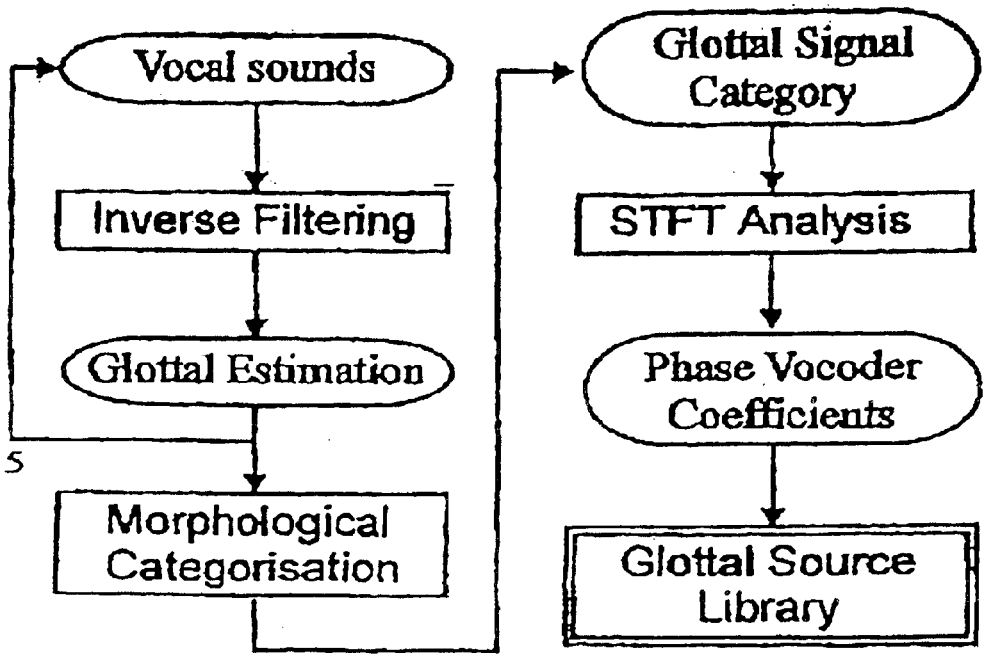
FIG. 4 is a flow diagram illustrating the main steps in the process of building the source sound category library according to preferred embodiments of the invention.

FIG. 4 illustrates the steps involved in the building up of the parametrical library of source sound categories according to preferred embodiments of the present invention. In this figure, items enclosed in rectangles are processes whereas items enclosed in ellipses are signals input/output from respective processes.

Figure 1:
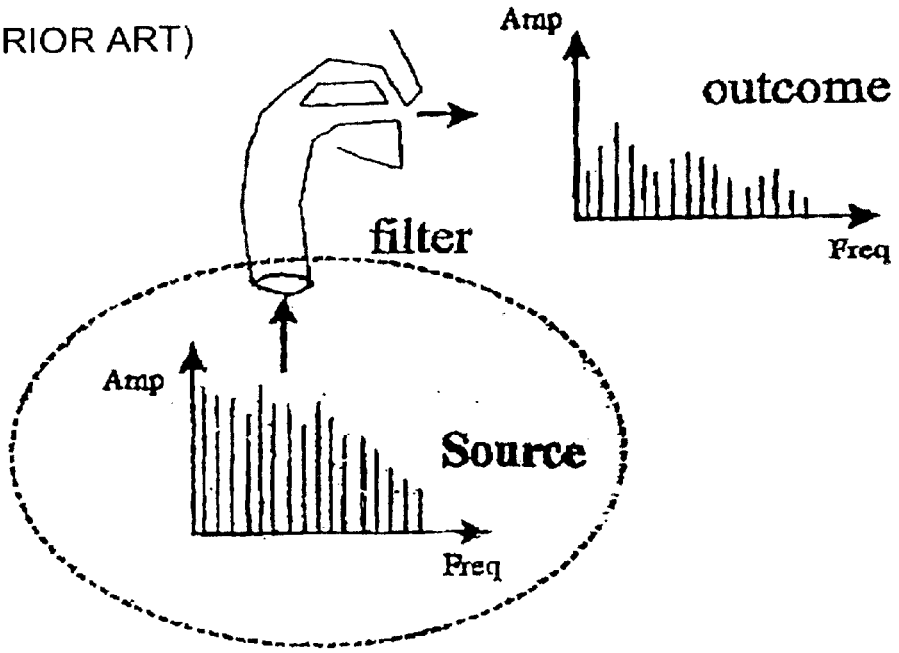
FIG. 1 (PRIOR ART)
FIG. 1 illustrates the principle behind source-filter type voice synthesis.
Figure 2:
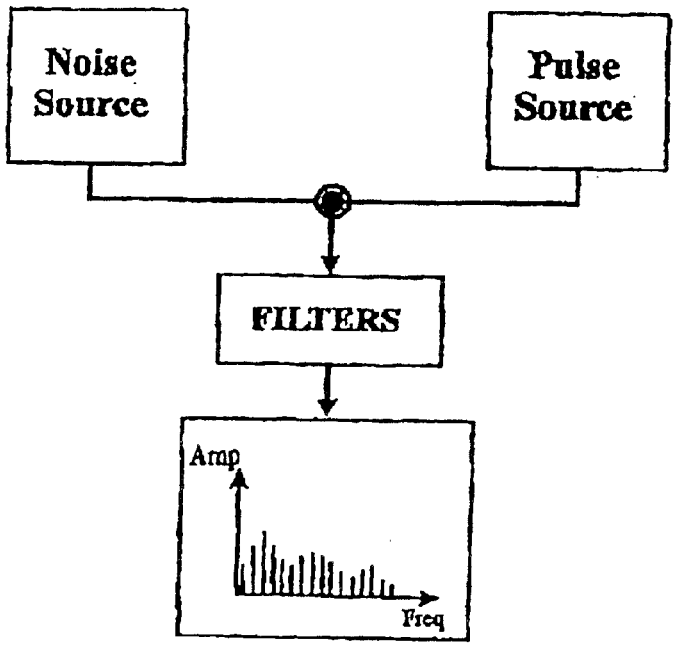
FIG. 2 (PRIOR ART)
FIG. 2 is a block diagram illustrating the general structure of a conventional voice synthesiser following the source-filter approach.
Figure 3:
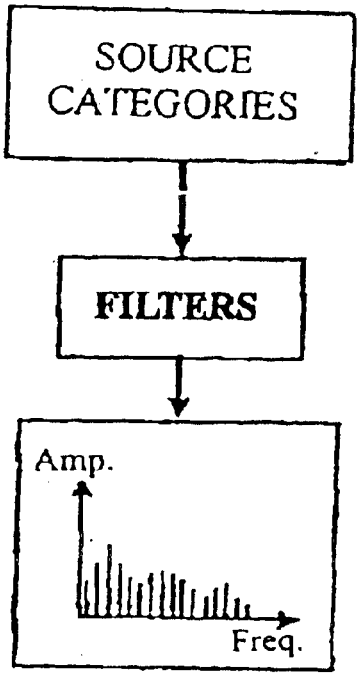
FIG. 3 is a block diagram illustrating the general structure of a voice synthesiser according to the preferred embodiments of the present invention.

As FIG. 4 shows, in the preferred embodiments, the stored signals are derived as follows: a real vocal sound (1) is detected and inverse-filtered (2) in order to subtract the articulatory effects that the vocal tract would have imposed on the source signal [see "SPASM: A Real-time Vocal Tract Physical Model Editor/Controller and Singer" by P. R. Cook, in Computer Music Journal, 17(1), pp. 30–42, 1993]. The reasoning behind the inverse filtering is that if an utterance $\omega_h$ is the result of a source-stream $S_h$ convoluted by a filter with response $\phi_h$ (see FIG. 1), then it is possible to estimate an approximation of the source-stream by deconvoluting the utterance:

$$\omega_h = s_h \phi_h \rightarrow s_h = \text{Erreur!}$$

Deconvolution can be achieved by means of any convenient technique, for example, autoregression methods such as cepstrum and linear predictive coding (LPC):

$$s_t = \sum_{i=1}^{p} \{\mu_i s_{t-1}\} - n_t$$

, where i is the $i^{th}$ filter coefficient, p is the number of filters, and $n_t$ is a noise signal.

See "The Computer Music Tutorial" by Curtis Roads, MIT Press, Cambridge, Mass. USA, 1996.

Figure 5:
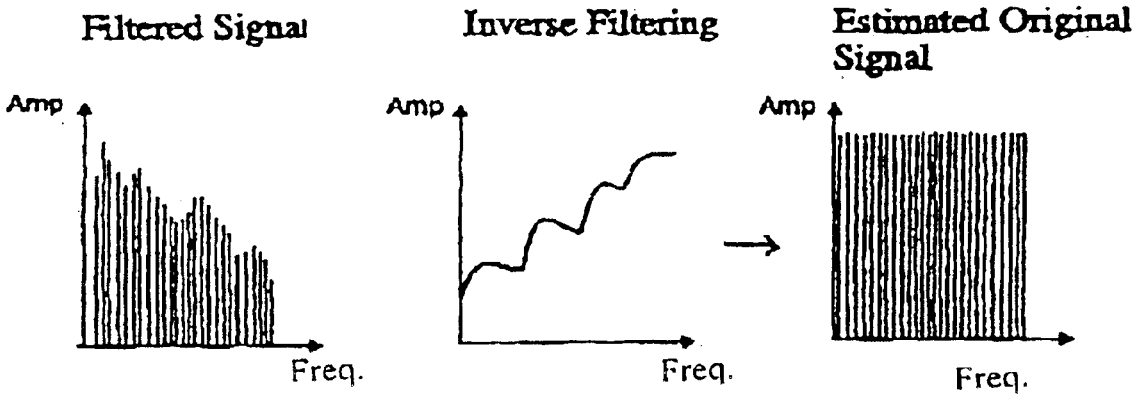
FIG. 5 schematically illustrates how a source sound signal (estimated glottal signal) is produced by inverse filtering.
Figure 7:
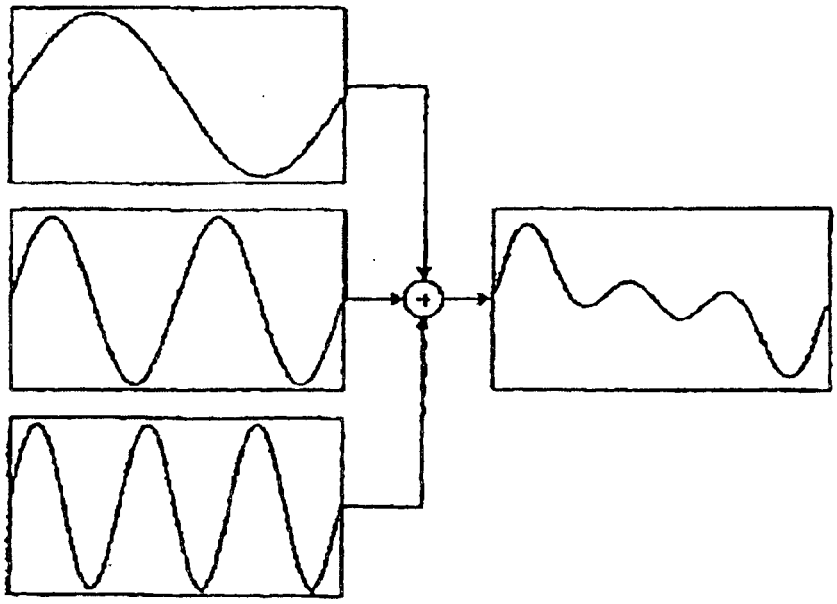
FIG. 7 schematically illustrates an additive sinusoidal technique implemented by an oscillator bank used in preferred embodiments of the invention.

FIG. 5 illustrates how the inverse-filtering process serves to generate an estimated glottal signal (item 3 in FIG.4).

The estimated glottal signal is assigned (4) to a morphological category which encapsulates generic utterance forms: e.g., "plosive consonant to back vowel", "front to back vowel", a certain emotive timbre, etc. For a given form (for example, a certain whispered vowel), a signal representing this form is computed by averaging the estimated glottal vowel signals resulting from inverse filtering various utterances of the respective form (5). The estimated glottal signal will be a short sound segment of variable length, the length being that necessary for characterising the glottal morphological category in question. The averaged signal representing a given form is here designated a "glottal signal category" (6).

For example, various instances of, say, the syllable /pa/ as in "park" and the syllable /pe/ as in "pedestrian" etc. are input to the system and the system builds a categorical representation from these examples. In this specific example, the generated categorical representation could be labelled "plosive to open vowel". When a specific example of a "plosive to open vowel" sound is to be synthesised, for example, the sound /pa/, a source signal is generated by accessing the "plosive to open vowel" categorical representation stored in the library. The parameters of the filters in the filter arrangement are set in a conventional manner so as to apply to this source signal a transfer function which will result in the desired specific sound /pa/.

The glottal signal categories could be stored in the library without further processing. However, it is advantageous to store, not the categories (source sound signals) themselves but encoded versions thereof. More particularly, according to preferred embodiments of the invention each glottal signal category is analysed using a Short Time Fourier transform (STFT) algorithm (7 in FIG.4) in order to produce coefficients (8) that can be used for resynthesis of the original source sound signal, preferably using a phase vocoder. These resynthesis coefficients are then stored in a glottal source library (9) for subsequent retrieval during the synthesis process in order to produce the respective source signal.

The STFT analysis breaks down the glottal signal category into overlapping segments and shapes each segment with an envelope:

$$X_{(m,k)} = \sum_{m=-\infty}^{\infty} (\chi_m h_{n-m}) e^{-j(2\pi/N)km}$$

where $X_m$ is the input signal, $h_{n-m}$ is the time-shifted window, n is a discrete time interval, k is the index for the frequency bin, N is the number of points in the spectrum (or the length of the analysis window), and $X_{(m,k)}$ is the Fourier transform of the windowed input at discrete time interval n for frequency bin k (see "Computer Music Tutorial" cited supra).

The analysis yields a representation of the spectrum in terms of amplitudes and frequency trajectories (in other words, the way in which the frequencies of the partials (frequency components) of the sound change over time), which constitute the resynthesis coefficients that will be stored in the library.

Figure 6:
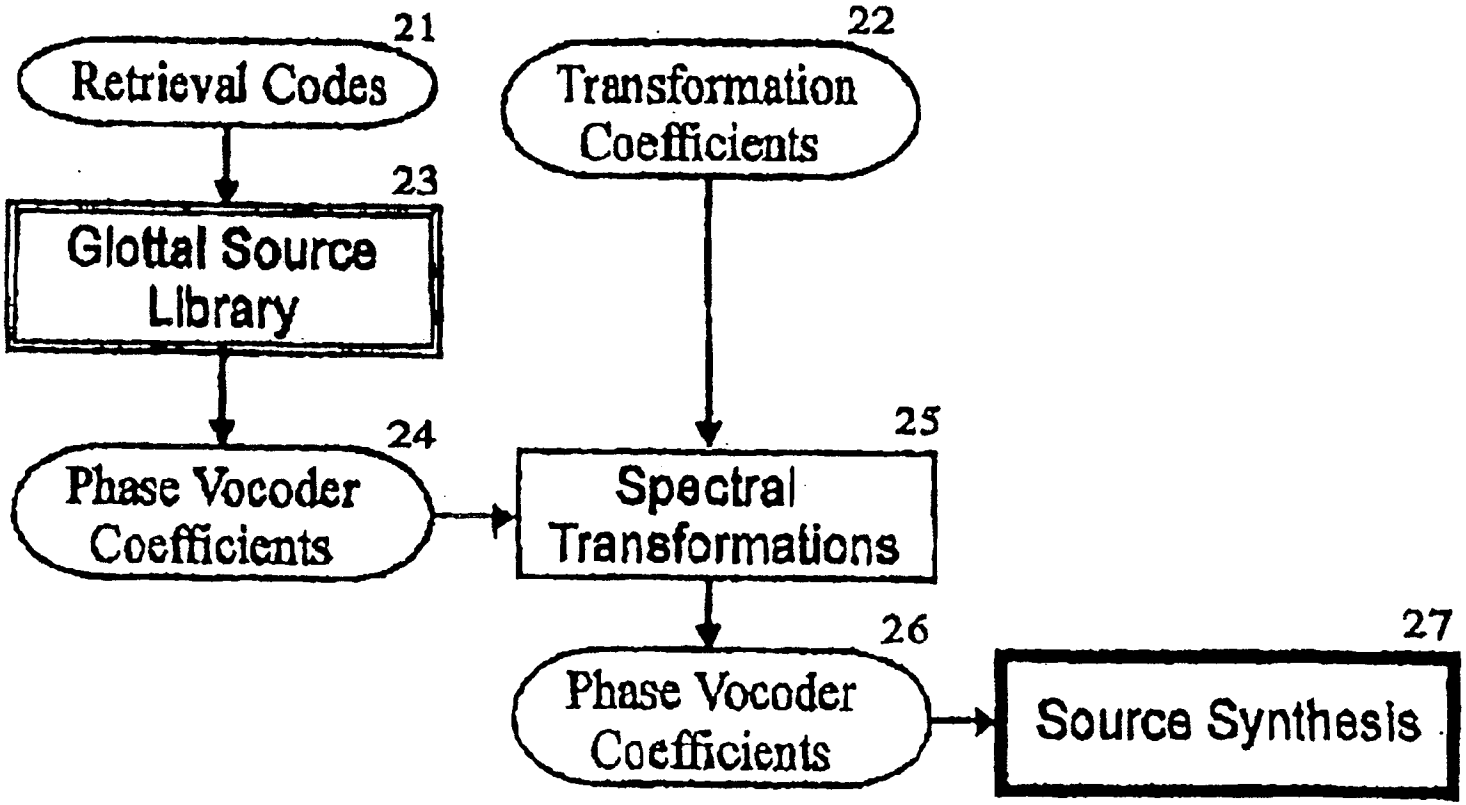
FIG. 6 is a flow diagram illustrating the main steps in the process for generating source sounds according to preferred embodiments of the invention.

As in conventional synthesisers of source-filter types, when an utterance is to be synthesised in the methods and apparatus according to the present invention, that utterance is broken down into a succession of component sounds which must be output successively in order to produce the final utterance in its totality. In order to generate the required succession of sounds at the output of the filter arrangement modelling the vocal tract, it is necessary to input an appropriate source-stream to that filter arrangement. FIG. 6 illustrates the main steps of the process for generating a source-stream, according to the preferred embodiments of the invention.

As shown in FIG. 6, it is first necessary to identify the sounds involved in the utterance and to retrieve from the library of source sound categories the codes (21) associated with sounds of the respective classes. These codes constitute the coefficients of a resynthesis device (e.g. a phase vocoder) and could, in theory, be fed directly to that device in order to regenerate the source sound signal in question (27). The resynthesis device used in preferred embodiments of the invention is a phase vocoder using an additive sinusoidal technique to synthesise the source stream. In other words, the amplitudes and frequency trajectories retrieved from the glottal source library drive a bank of oscillators each outputting a respective sinusoidal wave, these waves being summed in order to produce the final output source signal (see FIG. 7).

When synthesising an utterance composed of a succession of sounds, interpolation is applied to smooth the transition from one sound to the next. The interpolation is applied to the synthesis coefficients (24,25) prior to synthesis (27). (It is to be recalled that, as in standard filter arrangements of source-filter type synthesisers, the filter arrangement too will perform interpolation but, in this case, it is interpolation between the articulatory positions specified by the control means).

A major advantage of storing the glottal source categories in the form of resynthesis coefficients (for example, coefficients representing magnitudes and frequency trajectories) is that one can perform a number of operations on the spectral information of this signal, with the aim, for example, of fine-tuning or morphing (consonant-vowel, vowel-consonant). As illustrated in FIG. 6, if desired, the appropriate transformation coefficients (22) are used to apply spectral transformations (25) to the resynthesis coefficients (24) retrieved from the glottal source library. Then the transformed coefficients (26) are supplied to the resynthesis device for generation of the source-stream. It is possible, for example, to make gradual transitions from one spectrum to another, change the spectral envelope and spectral contents of the source, and mix two or more spectra.

Figure 8:
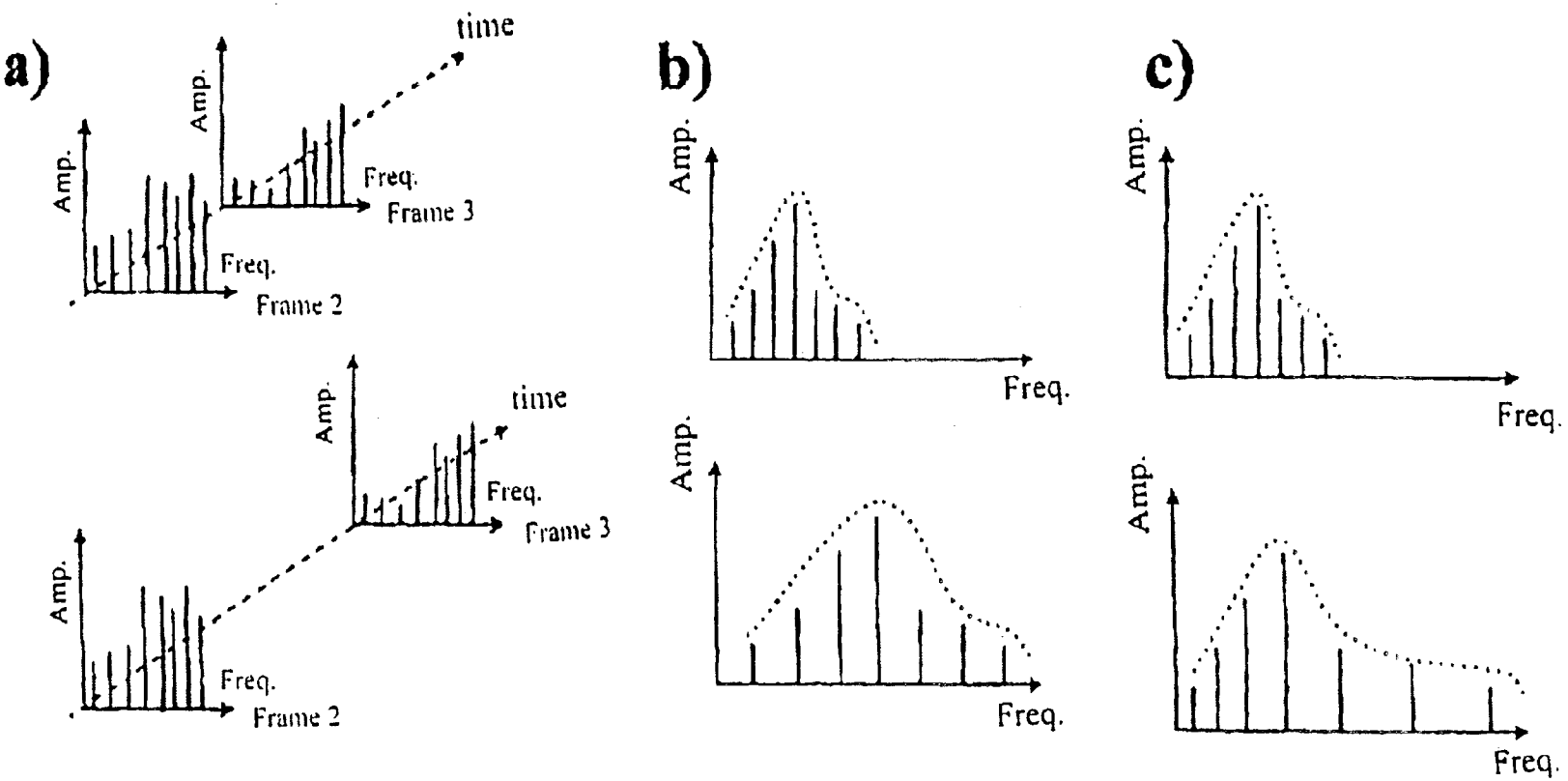

Some examples of spectral transformations that may be applied to the glottal source categories retrieved from the glottal source library are illustrated in FIG. 8. These transformations include time-stretching (see FIG. 8*a*)), spectral shift (see FIG. 8*b*)) and spectral stretching (see FIG. 8*c*)). In the case illustrated in FIG. 8*a*, the trajectory of the amplitudes of the partials changes over time. In the cases illustrated in FIGS. 8*b* and 8*c*, it is the frequency trajectory that changes over time.

Spectral time stretching (FIG. 8*a*) works by increasing the distance (time interval) between the analysis frames of the original sound (top trace of FIG. 8*a*) in order to produce a transformed signal which is the spectrum of the sound stretched in time (bottom trace). Spectral shift (FIG. 8*b*) works by changing the distances (frequency intervals) between the partials of the spectrum: whereas the interval between the frequency components may be $\Delta f$ in the original spectrum (top trace) it becomes $\Delta f'$ in the transformed spectrum (bottom trace of FIG. 8*b*), where $\Delta f' \neq \Delta f$. Spectral stretching (FIG. 8*c*) is similar to spectral shift except that in the case of spectral stretching the respective distances (frequency intervals) between the frequency components are no longer constant—the distances between the partials of the spectrum are altered so as to increase exponentially.

It is also possible to enhance the expressivity (or the so-called "emotion") of the final speech signal by altering the way in which the pitch of the resynthesized source signal varies over time. Such a time-based transformation makes it possible, for example, to take a relatively flat speech signal and make it more melodic, or transform an affirmative sentence to a question (by raising the pitch at the end), and so on.

In the context of the present invention, the preferred method of implementing such time-based transformations is the above-mentioned PSOLA technique. This technique is described in, for example, "Voice transformation using PSOLA technique" by H. Valbret, E. Moulines & J. P. Tulbach, in Speech Communication, 11, no. 2/3, June 1992, pp. 175–187.

The PSOLA technique is applied to make appropriate modifications of the source signal (after resynthesis thereof) before the transformed source signal is fed to the filter arrangement modelling the vocal tract. Thus, it is advantageous to add a module implementing the PSOLA technique and operating on the output from the source synthesis unit 27 of FIG. 6.

As mentioned above, when it is desired to synthesise a specific sound, a source signal is generated based on the categorical representation stored in the library for sounds of this class or morphological category, and the filter arrangement is arranged to modify the source signal in known manner so as to generate the desired specific sound in this class. The results of the synthesis are improved because the raw material on which the filter arrangement is working has more appropriate components than those in source signals generated by conventional means.

The voice synthesis technique according to the present invention improves limitation a) (detailed above) of the standard glottal model, in the sense that the morphing between vowels and consonants is more realistic as both signals emanate from the same type of source (rather than from noise and/or pulse sources). Thus, the synthesised utterances have improved smoothness.

In the preferred embodiments of the invention, limitations b) and c) have also improved significantly because we can now manipulate the synthesis coefficients in order to change the spectrum of the source signal. Thus, the system has greater flexibility. Different glottal qualities (e.g. expressive synthesis, addition of emotion, simulation of the idiosyncrasies of a particular voice) can be simulated by changing the values of the phase vocoder coefficients before applying the re-synthesis process. This automatically implies an improvement of limitation d) as we now can specify time varying functions that change the source during phonation. Richer prosody can therefore be obtained.

The present invention is based on the notion that the source component of the source-filter model is as important as the filter component and provides a technique to improve the quality and flexibility of the former. The potential of this technique could be exploited even more advantageously by finding a methodology to define particular spectral operations. The real glottis manages very subtle changes in the spectrum of the source sounds but the specification of the phase vocoder coefficients to simulate these delicate operations is not a trivial task.

It is to be understood that the present invention is not limited by the features of the specific embodiments described above. More particularly, various modifications may be made to the preferred embodiments within the scope of the appended claims.

Also, it is to be understood that references herein to the vocal tract do not limit the invention to systems that mimic human voices. The invention covers systems which produce a synthesised voice (e.g. voice for a robot) which the human vocal tract typically will not produce.

What is claimed is:

1. Voice synthesiser apparatus comprising:

a source module adapted to output, during use, a source signal;

a filter module arranged to receive said source signal as an input and to apply thereto a filter characteristic modelling the response of the vocal tract;

characterised in that the source module comprises a library of stored representations of source sound categories each corresponding to a respective morphological category, and that the source signal output by the source module corresponds to a stored representation of a selected source sound category;

wherein the source module comprises a resynthesis device adapted to output said source signal and that the stored representations in said library are in the form of resynthesis coefficients enabling said source sound categories to be regenerated by the resynthesis device;

wherein the stored representations in said library are derived by inverse filtering real vocal sounds so as to subtract the articulatory effects imposed by the vocal tract, and stored representations corresponding to a particular morphological category are derived by averaging signals that are produced by inverse filtering a plurality of examples of vocal sounds embodying the morphological category.

2. Voice synthesis apparatus according to claim 1, wherein the stored representations in said library are derived by deconvoluting respective portions of an utterance.

3. Voice synthesis apparatus according to claim 1, wherein the resynthesis device comprises a phase vocoder adapted to output glottal signals for submission to said filter module, and the resynthesis coefficients constituting the stored representation of a source sound category correspond to a representation derived by STFT analysis of signals resulting from the inverse filtering.

4. Voice synthesis apparatus according to claim 3, and comprising means for performing spectral transformations on said resynthesis coefficients, wherein the phase vocoder is driven by the transformed resynthesis coefficients.

5. Voice synthesis apparatus according to claim 1, wherein the pitch of the source signal varies as a function of time, and there is provided means for transforming the source signal by modifying the pitch variation function, the filter module being adapted to operate on the source signal after transformation thereof by said transforming means.

6. A method of voice synthesis comprising the steps of:

providing a source module, causing said source module to generate a source signal corresponding to a particular morphological category of sound, providing a filter module having a filter characteristic modelling the response of the vocal tract;

inputting the source signal to the filter module, characterised in that the step of providing a source module comprises providing a source module comprising a library of stored representations of source sound categories each corresponding to a respective morphological category, and that the source signal output by the source module corresponds to a stored representation of a selected source sound category, wherein the source module outputs a source signal by retrieval from the library of a stored representation in the form of resynthesis coefficients representing the corresponding morphological category, input of the retrieved resynthesis coefficients to a resynthesis device, and output of the signal generated by the resynthesis device as the source signal, wherein the stored representations in said library are derived by inverse filtering real vocal sounds so as to subtract the articulatory effects imposed by the vocal tract, and stored representations corresponding to a particular morphological category are derived by averaging signals that are produced by inverse filtering a plurality of examples of vocal sounds embodying the morphological category.

7. A voice synthesis method according to claim 6, wherein the stored representations in said library are derived by deconvoluting respective portions of an utterance.

8. A voice synthesis method according to claim 6, wherein the resynthesis device comprises a phase vocoder adapted to output glottal signals to said filter module, and the resynthesis coefficients constituting the stored representation of a source sound category correspond to a representation derived by STFT analysis of signals resulting from the inverse filtering.

9. A voice synthesis method according to claim 8, wherein a spectral transformation is applied to the retrieved resynthesis coefficients, and the transformed coefficients are used to drive the phase vocoder.

10. A voice synthesis method according to claim 6, wherein the pitch of the source signal varies as a function of time, and comprising the step of transforming the source signal by modifying the pitch variation function, the filter module being adapted to operate on the source signal after transformation thereof in said transforming step.

* * * * *